US007476083B2

(12) United States Patent
Snook et al.

(10) Patent No.: US 7,476,083 B2
(45) **Date of Patent: *Jan. 13, 2009**

(54) BLADE/DISK DOVETAIL BACKCUT FOR BLADE/DISK STRESS REDUCTION (7FA+E, STAGE 1)

(75) Inventors: Daniel David Snook, Moore, SC (US); John Herbert Dimmick, III, Greenville, SC (US); Rachel Jane Obermeyer, West Chester, OH (US); Ariel Caesar Prepena Jacala, Simpsonville, SC (US); Robert Craig Akin, Greer, SC (US)

(73) Assignee: General Electric Company, Schenectady, NY (US)

( * ) Notice: Subject to any disclaimer, the term of this patent is extended or adjusted under 35 U.S.C. 154(b) by 181 days.

This patent is subject to a terminal disclaimer.

(21) Appl. No.: 11/476,095

(22) Filed: Jun. 28, 2006

(65) Prior Publication Data

US 2008/0260534 A1 Oct. 23, 2008

Related U.S. Application Data

(63) Continuation of application No. PCT/US06/18468, filed on May 12, 2006.

(60) Provisional application No. 60/681,169, filed on May 16, 2005, provisional application No. 60/681,455, filed on May 17, 2005.

(51) Int. Cl.
*F01D 5/30* (2006.01)

(52) U.S. Cl. ..... 416/219 R; 416/248

(58) Field of Classification Search ..... None
See application file for complete search history.

(56) References Cited

U.S. PATENT DOCUMENTS

| | | | | |
|---|---|---|---|---|
| 3,957,450 | A | 5/1976 | Salt | |
| 5,573,377 | A | 11/1996 | Bond et al. | |
| 5,846,054 | A | 12/1998 | Mannava et al. | |
| 6,033,185 | A | 3/2000 | Lammas et al. | |
| 6,059,525 | A | 5/2000 | Jiomacas et al. | |
| 6,183,202 | B1 * | 2/2001 | Ganshaw | 416/219 R |
| 6,375,423 | B1 | 4/2002 | Roberts et al. | |
| 6,390,775 | B1 | 5/2002 | Paz | |
| 6,439,851 | B1 * | 8/2002 | Wong | 416/219 R |
| 6,520,836 | B2 | 2/2003 | Dean et al. | |
| 2003/0194321 | A1 * | 10/2003 | Barnette et al. | 416/219 R |

* cited by examiner

*Primary Examiner*—Richard Edgar
(74) *Attorney, Agent, or Firm*—Nixon & Vanderhye P.C.

(57) ABSTRACT

Blade load path on a gas turbine disk can be diverted to provide a significant disk fatigue life benefit. A plurality of gas turbine blades are attachable to a gas turbine disk, where each of the gas turbine blades includes a blade dovetail engageable in a correspondingly-shaped dovetail slot in the gas turbine disk. In order to reduce gas turbine disk stress, an optimal material removal area is defined according to blade and/or disk geometry to maximize a balance between stress reduction on the gas turbine disk, a useful life of the gas turbine blade, and maintaining or improving the aeromechanical behavior of the gas turbine blade. Removing material from the material removal area effects the maximized balance.

12 Claims, 12 Drawing Sheets

The plane containing Datum W is located 2.470 inches from a line containing Pt. W1 as measured along Datum S (centerline of the dovetail axis). Pt. W1 is in the fwd face of the dovetail.

The plane containing Datum W is located 2.470 inches from a line containing Pt. W1 as measured along Datum S (centerline of the dovetail axis). Pt. W1 is in the fwd face of the dovetail.

The plane containing Datum W is located 2.817 inches from a line containing Pt. W1 as measured along Datum S (centerline of the dovetail axis). Pt. W1 is in the fwd face of the dovetail.

BLADE/DISK DOVETAIL BACKCUT FOR BLADE/DISK STRESS REDUCTION (7FA+E, STAGE 1)

CROSS-REFERENCE TO RELATED APPLICATION

This application is a continuation of PCT International Patent Application No. PCT/US06/18468, filed May 12, 2006, which claims the benefit of U.S. Provisional Patent Application Ser. No. 60/681,169 filed May 16, 2005 and U.S. Provisional Patent Application Ser. No. 60/681,455, filed May 17, 2005, the entire contents of which are herein incorporated by reference.

BACKGROUND OF THE INVENTION

The present invention relates to gas turbine technology and, more particularly, to a modified blade and/or disk dovetail designed to divert the blade load path around a stress concentrating feature in the disk on which the blade is mounted and/or a stress concentrating feature in the blade itself.

Certain gas turbine disks include a plurality of circumferentially spaced dovetails about the outer periphery of the disk defining dovetail slots therebetween. Each of the dovetail slots receives in an axial direction a blade formed with an airfoil portion and a blade dovetail having a shape complementary to the dovetail slots.

The blades may be cooled by air entering through a cooling slot in the disk and through grooves or slots formed in the dovetail portions of the blades Typically, the cooling slot extends circumferentially 360° through the alternating dovetails and dovetail slots.

It has been found that interface locations between the blade dovetails and the dovetail slots are potentially life-limiting locations due to overhanging blade loads and stress concentrating geometry. In the past, dovetail backcuts have been used in certain turbine engines to relieve stresses. These backcuts, however, were minor in nature and were unrelated to the problem addressed here. Moreover, the locations and removed material amounts were not optimized to maximize a balance between stress reduction on the disk, stress reduction on the blades, and a useful life of the blades.

BRIEF DESCRIPTION OF THE INVENTION

In an exemplary embodiment of the invention, a method reduces stress on at least one of a turbine blade or a rotor disk. A plurality of turbine blades are attachable to the disk, and each of the turbine blades includes a blade dovetail engageable in a correspondingly-shaped dovetail slot in the disk. The method includes the steps of (a) determining a start point for a dovetail backcut relative to a datum line, the start point defining a length of the dovetail backcut along a dovetail axis; (b) determining a cut angle for the dovetail backcut; and (c) removing material from at least one of the blade dovetail or the disk dovetail slot according to the start point and the cut angle to form the dovetail backcut. The start point and the cut angle are optimized according to blade and disk geometry to maximize a balance between stress reduction on the disk, stress reduction on the blade, a useful life of the turbine blades, and maintaining or improving the aeromechanical behavior of the turbine blade. Additionally, the datum line is positioned a fixed distance from a forward face of the blade dovetail along a centerline of the dovetail axis, and step (a) is practiced such that the start point of the dovetail backcut is at least 1.945 inches in an aft direction from the datum line.

In another exemplary embodiment of the invention, a turbine blade includes an airfoil and a blade dovetail, where the blade dovetail is shaped corresponding to a dovetail slot in a turbine disk. The blade dovetail includes a dovetail backcut sized and positioned according to blade geometry to maximize a balance between stress reduction on the rotor disk, stress reduction on the blade, a useful life of the turbine blade, and maintaining or improving the aeromechanical behavior of the turbine blade. A start point of the dovetail backcut, which defines a length of the dovetail backcut along a dovetail axis, is determined relative to a datum line positioned a fixed distance from a forward face of the blade dovetail along a centerline of the dovetail axis. The start point of the dovetail backcut is at least 1.945 inches in an aft direction from the datum line.

In yet another exemplary embodiment of the invention, a turbine rotor includes a plurality of turbine blades coupled with a rotor disk, each blade including an airfoil and a blade dovetail, and the rotor disk including a plurality of dovetail slots shaped corresponding to the blade dovetail. At least one of the blade dovetail and the dovetail slot includes a dovetail backcut sized and positioned according to blade and disk geometry to maximize a balance between stress reduction on the rotor disk, stress reduction on the blade, a useful life of the turbine blade, and maintaining or improving the aeromechanical behavior of the turbine blade. A start point of the dovetail backcut, which defines a length of the dovetail backcut along a dovetail axis, is determined relative to a datum line positioned a fixed distance from a forward face of the blade dovetail along a centerline of the dovetail axis. The start point of the dovetail backcut is at least 1.945 inches in an aft direction from the datum line.

DETAILED DESCRIPTION OF THE INVENTION

Figure 1:
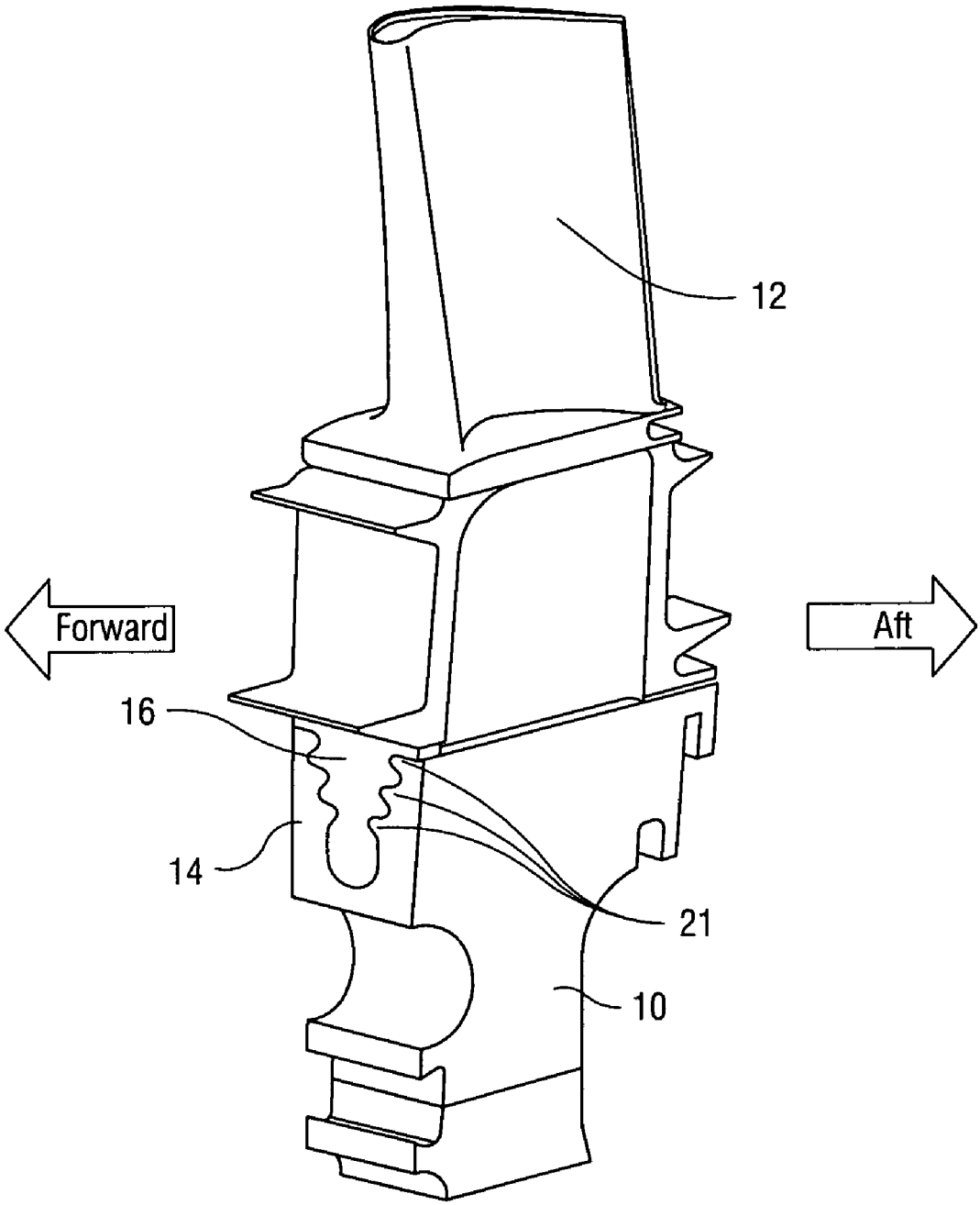
FIG. 1 is a perspective view of an exemplary gas turbine disk segment with attached gas turbine blade.
Figure 2:
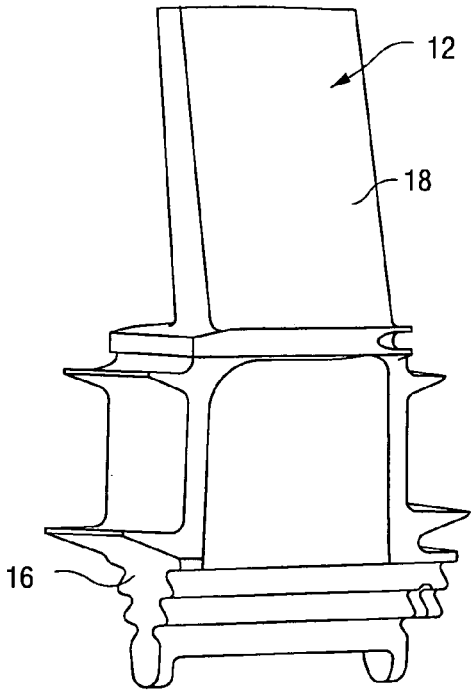
FIG. 2 is a perspective view of the pressure side of the exemplary gas turbine blade.
Figure 3:
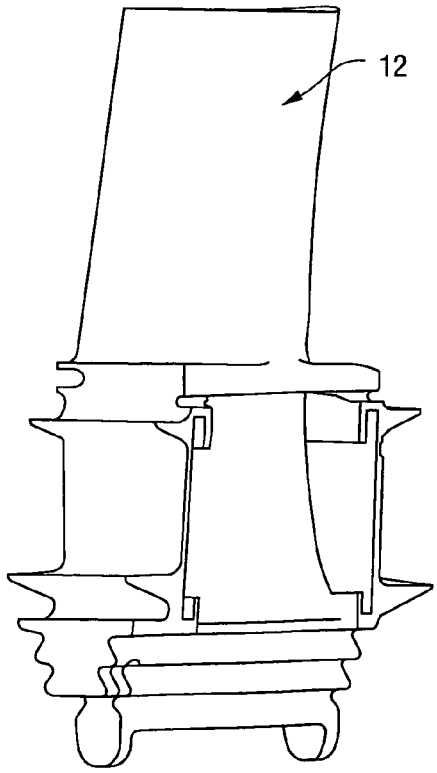
FIG. 3 is a perspective view of the suction side of the exemplary gas turbine blade.
Figure 5:
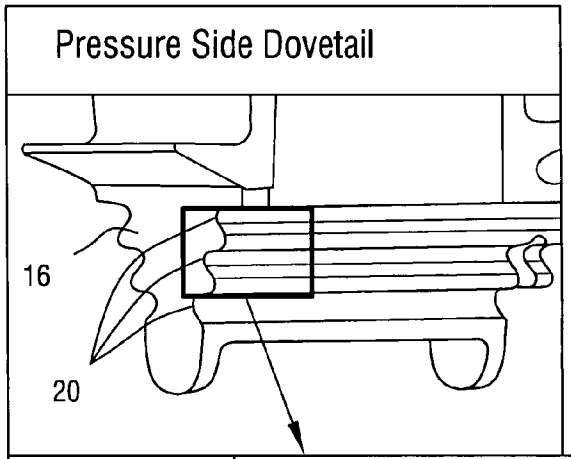
FIGS. 4-7 illustrate close-up views of blade or disk dovetail areas in which material will be removed.

FIG. 1 is a perspective view of an exemplary gas turbine disk segment 10 in which is secured a gas turbine blade 12. The gas turbine disk 10 includes a dovetail slot 14 that receives a correspondingly shaped blade dovetail 16 to secure the gas turbine blade 12 to the disk 10. FIGS. 2 and 3 show opposite sides of a bottom section of the gas turbine blade 12 including an airfoil 18 and the blade dovetail 16. FIG. 2 illustrates a so-called pressure side of the gas turbine blade 12, and FIG. 3 illustrates a so-called suction side of the gas turbine blade 12.

The dovetail slots 14 are typically termed "axial entry" slots in that the dovetails 16 of the blades 12 are inserted into the dovetail slots 14 in a generally axial direction, i.e., generally parallel but skewed to the axis of the disk 10.

An example of a gas turbine disk stress concentrating feature is the cooling slot. The upstream or downstream face of the blade and disk 10 may be provided with an annular cooling slot that extends circumferentially a full 360°, passing through the radially inner portion of each dovetail 16 and dovetail slot 14. It will be appreciated that when the blades are installed on the rotor disk 10, cooling air (e.g., compressor discharge air) is supplied to the cooling slot which in turn supplies cooling air into the radially inner portions of the dovetail slots 14 for transmittal through grooves or slots (not shown) opening through the base portions of the blades 12 for cooling the interior of the blade airfoil portions 18.

A second example of a gas turbine disk stress concentrating feature is the blade retention wire slot. The upstream or downstream face of the blade 12 and disk 10 may be provided with an annular retention slot that extends circumferentially a full 360°, passing through the radially inner portion of each dovetail 16 and dovetail slot 14. It will be appreciated that when the blades are installed on the rotor disk 10, a blade retention wire is inserted into the retention wire slot which in turn provides axial retention for the blades.

The features described herein are generally applicable to any airfoil and disk interface. The structure depicted in FIGS. 1-3 is merely representative of many different disk and blade designs across different classes of turbines. For example, at least three classes of gas turbines including disks and blades of different sizes and configurations are manufactured by General Electric Company of Schenectady, New York including, for example, GE's 6FA (and 6FA+e), 7FA+e and 9FA+e turbines. Each turbine additionally includes multiple stages within the turbine having varying blade and disk geometries.

It has been discovered that the interface surfaces between the blade dovetail 16 and the disk dovetail slot 14 are subject to stress concentrations that are potentially life-limiting locations of the turbine disk 10 and/or turbine blade 12. It would be desirable to reduce such stress concentrations to maximize the life span of the disk and/or blade without negatively impacting the life span or aeromechanical behavior of the gas turbine blades.

Figure 7:
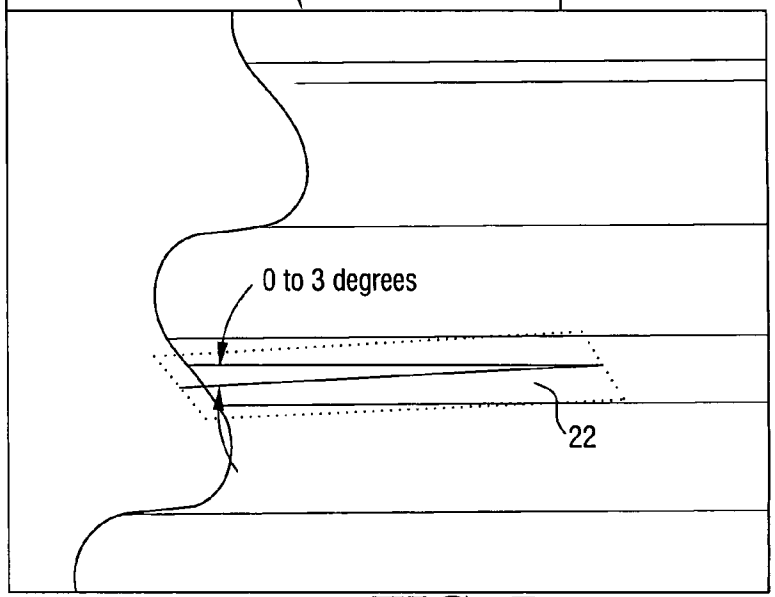
Figure 4:
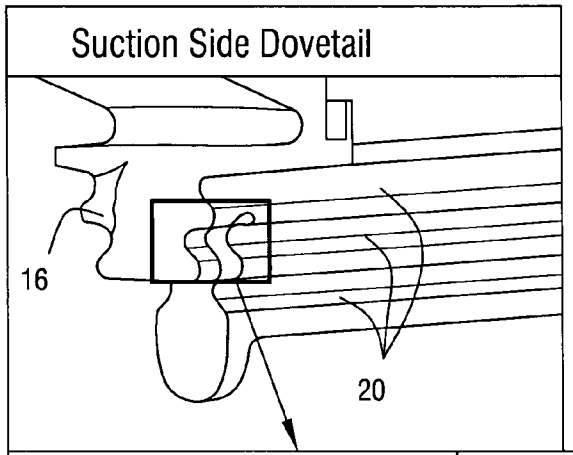
Figure 6:
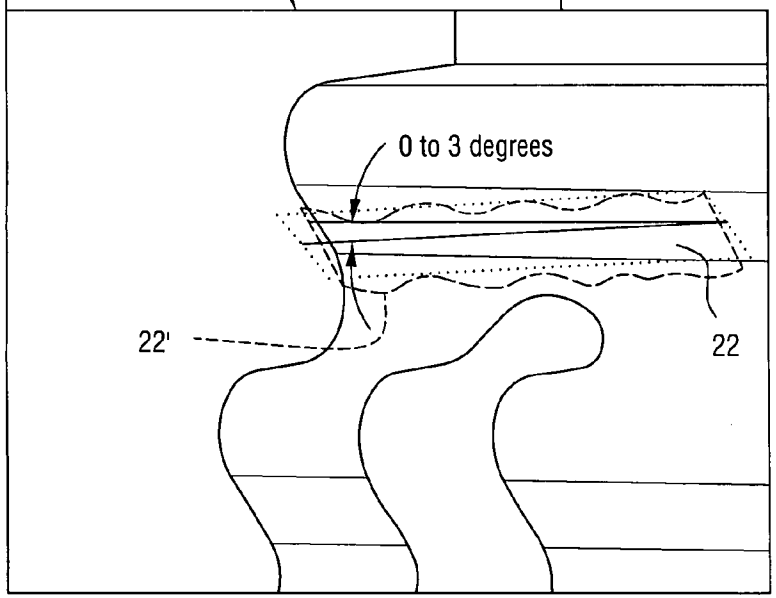

With reference to FIGS. 4-7, the gas turbine blade dovetail 16 includes a number of pressure faces or tangs 20 on the dovetail pressure side and a number of pressure faces or tangs 20 on the dovetail suction side. Depending on the turbine class and blade and disk stage, a backcut 22 may be made on either or both of the suction side aft end and pressure side forward end of the blade dovetail tangs 20 or disk dovetail tangs 21 (see FIG. 1). With particular reference to FIGS. 6 and 7, the backcut 22 is formed by removing material from the pressure faces 20 of the blade dovetail 16 or disk dovetail slot 14. The material can be removed using any suitable process such as a grinding or milling process or the like, which may be the same as or similar to the corresponding process used for forming the blade dovetail 16 or disk dovetail slot 14.

The amount of material to be removed and thus the size of the backcut 22 is determined by first determining a start point for the dovetail backcut relative to a datum line, the start point defining the length of the dovetail backcut along the dovetail axis. A cut angle is also determined for the dovetail backcut, the exemplary angle shown in FIGS. 6 and 7 is a maximum of 3°. The start point and the cut angle are optimized according to blade and disk geometry to maximize a balance between stress reduction on the gas turbine disk 10, stress reduction of the gas turbine blade 12, a useful life of the gas turbine blade 12, and maintaining or improving the aeromechanical behavior of the gas turbine blade. As such, if a dovetail backcut 22 is too large, the backcut will have a negative effect on the life span of the turbine blade 12. If the dovetail backcut is too small, although the life of the turbine blade will be maximized, stress concentrations in the interface between the turbine blade and the disk will not be minimized, and the disk would not benefit from a maximized life span.

The backcut 22 may be planar or as shown in dashed-line in FIG. 6, the backcut 22' may alternatively be non-planar. In this context, the cut angle is defined as a starting cut angle. For some turbine classes, the cut angle is pertinent from the start point-until the backcut 22, 22' is deep enough that the blade loading face of the blade dovetail 16 loses contact with the disk dovetail slot 14. Once contact is lost with the disk slot 14, any cut of any depth or shape outside the defined envelope would be acceptable.

As discussed above, where the blade dovetail 16 and disk dovetail slot 14 includes a number of tangs 20, a start point and/or cut angle for the dovetail backcut may be determined separately for each of the number of tangs. In a related context, as also referenced above, dovetail backcuts may be formed in one or both of the pressure side and suction side of the turbine blade and/or disk.

Optimization of the start point and cut angle for the dovetail backcut is determined by executing finite element analyses on the blade and disk geometry. Virtual thermal and structural loads based on engine data are applied to the blade and disk finite element grids to simulate engine operating conditions. The no-backcut geometry and a series of varying backcut geometries are analyzed using the finite element model. A transfer function between backcut geometry and blade and disk stresses is inferred from the finite element analyses. The predicted stresses are then correlated to field data using proprietary materials data in order to predict blade and disk lives and blade aeromechanical behavior for each backcut geometry. The optimum backcut geometry and acceptable backcut geometry range are determined through consideration of both the blade and disk life and the blade aeromechanical behavior.

Figure 21:
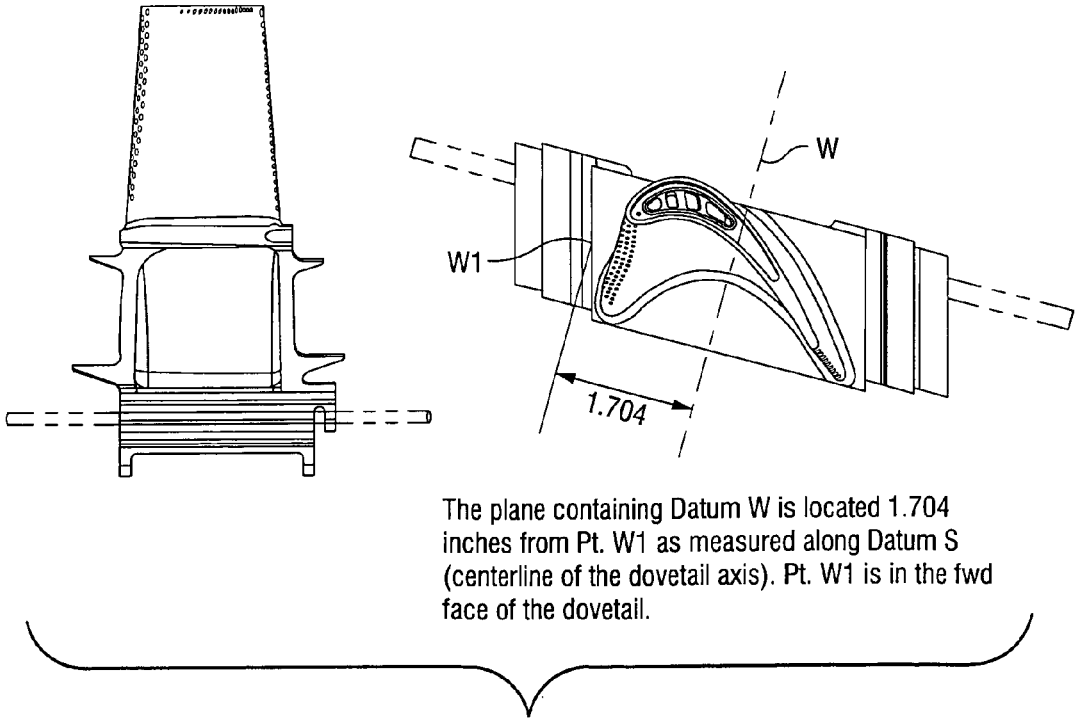
FIGS. 21-27 illustrate the determination of datum line W for each stage blade or disk of each turbine class.
Figure 22:
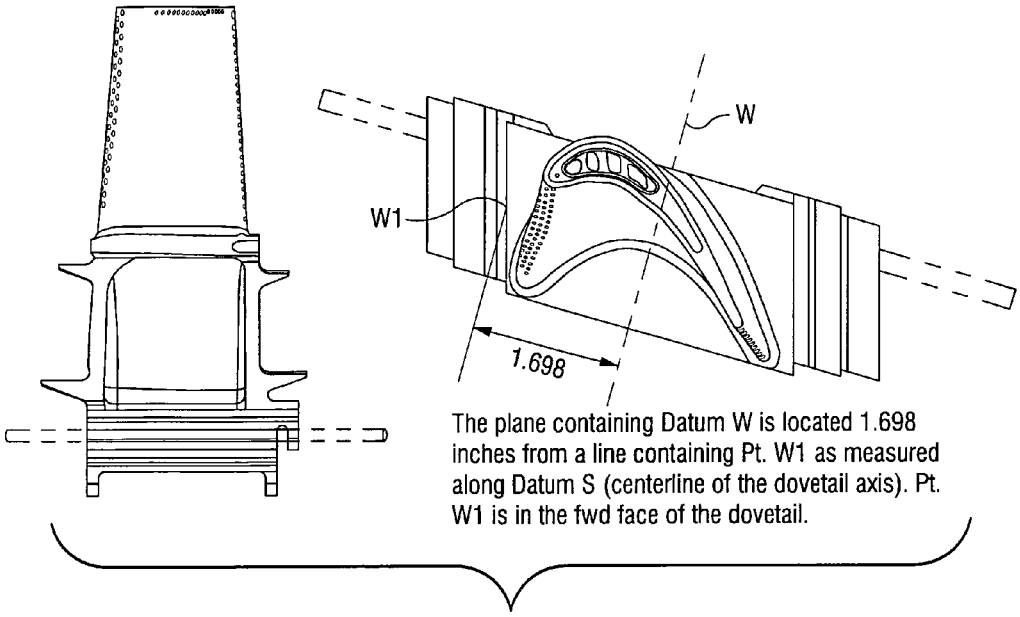
Figure 23:
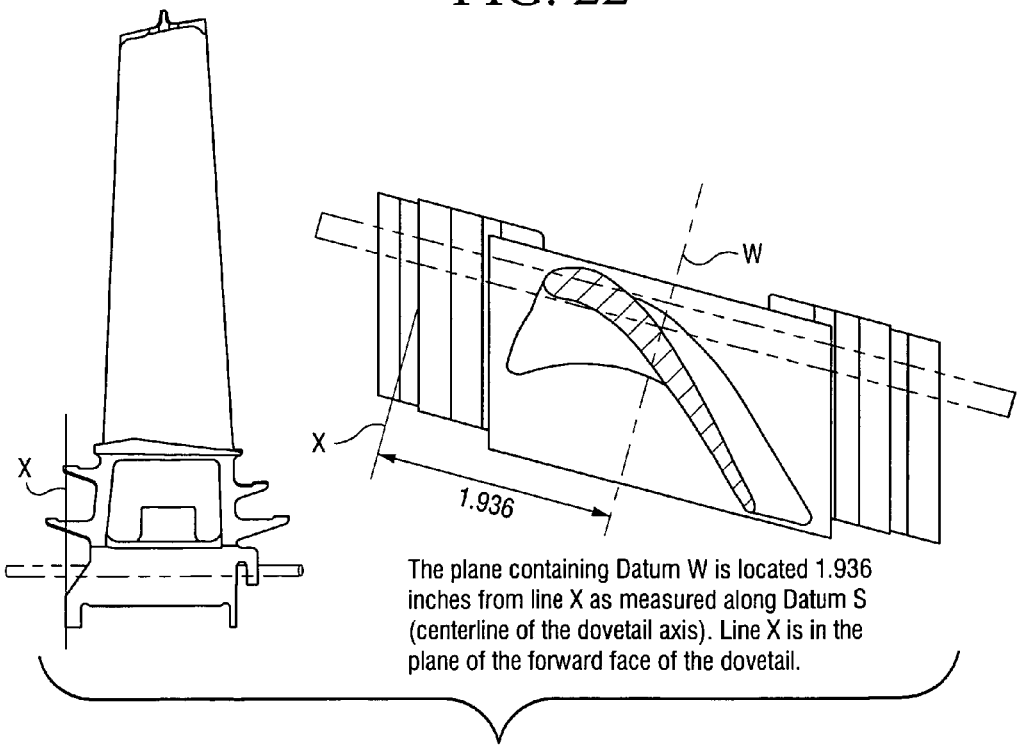
Figure 24:
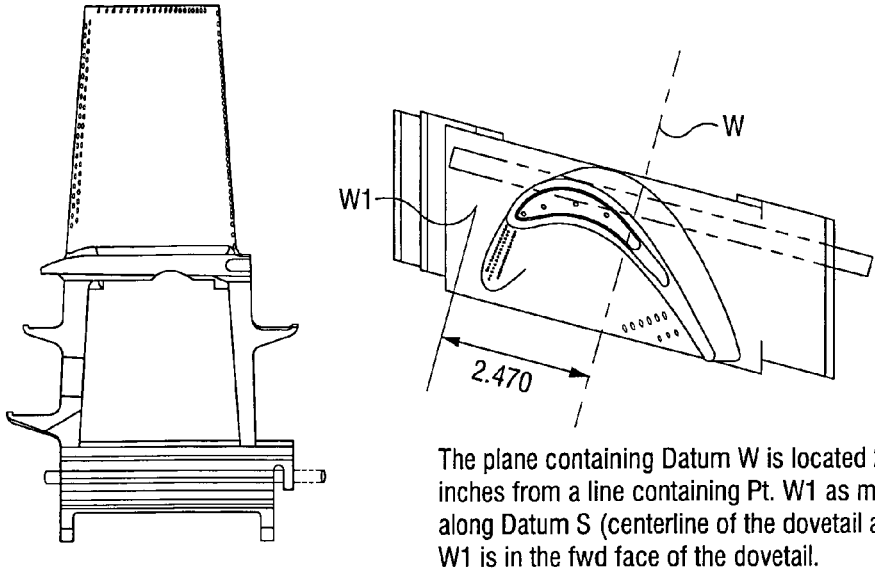
Figure 25:
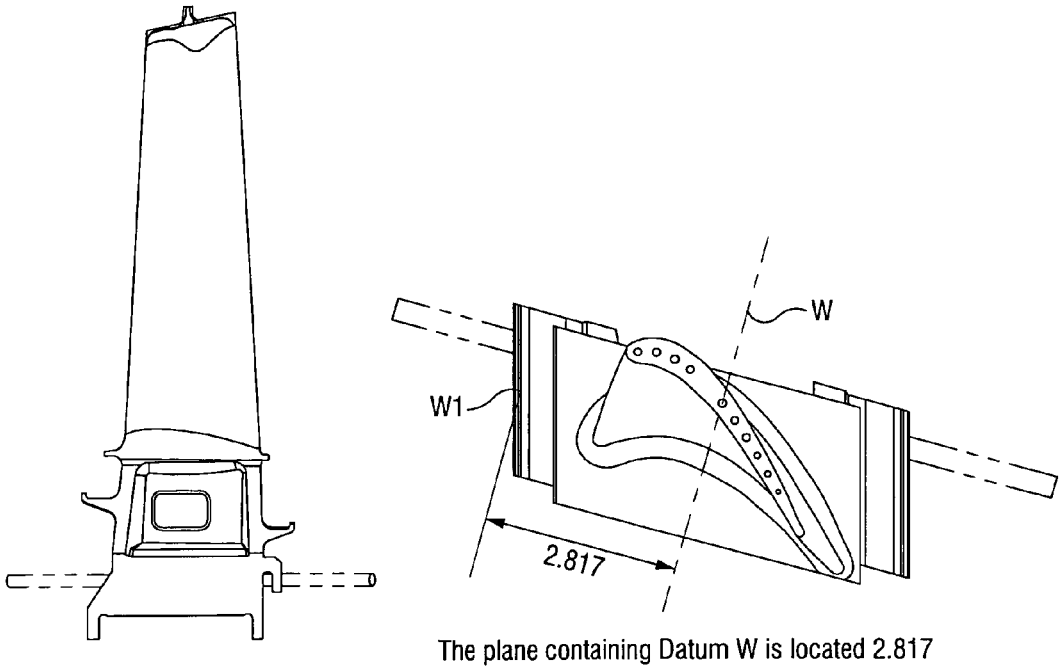
Figure 26:
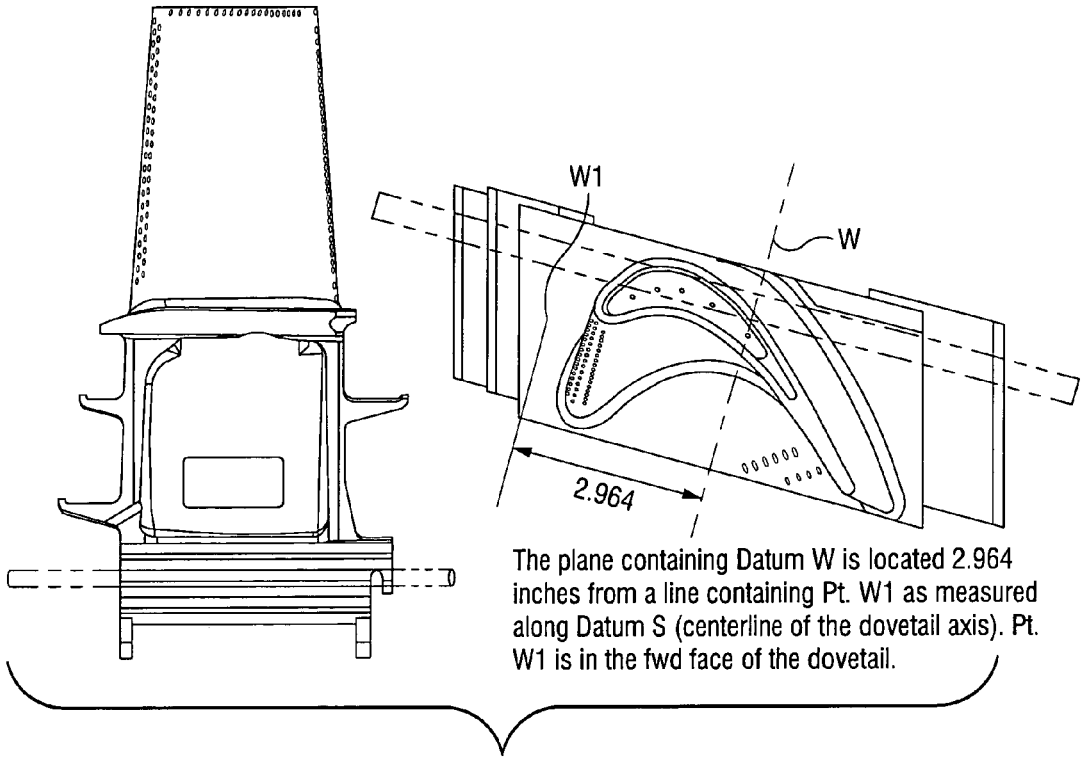
Figure 27:
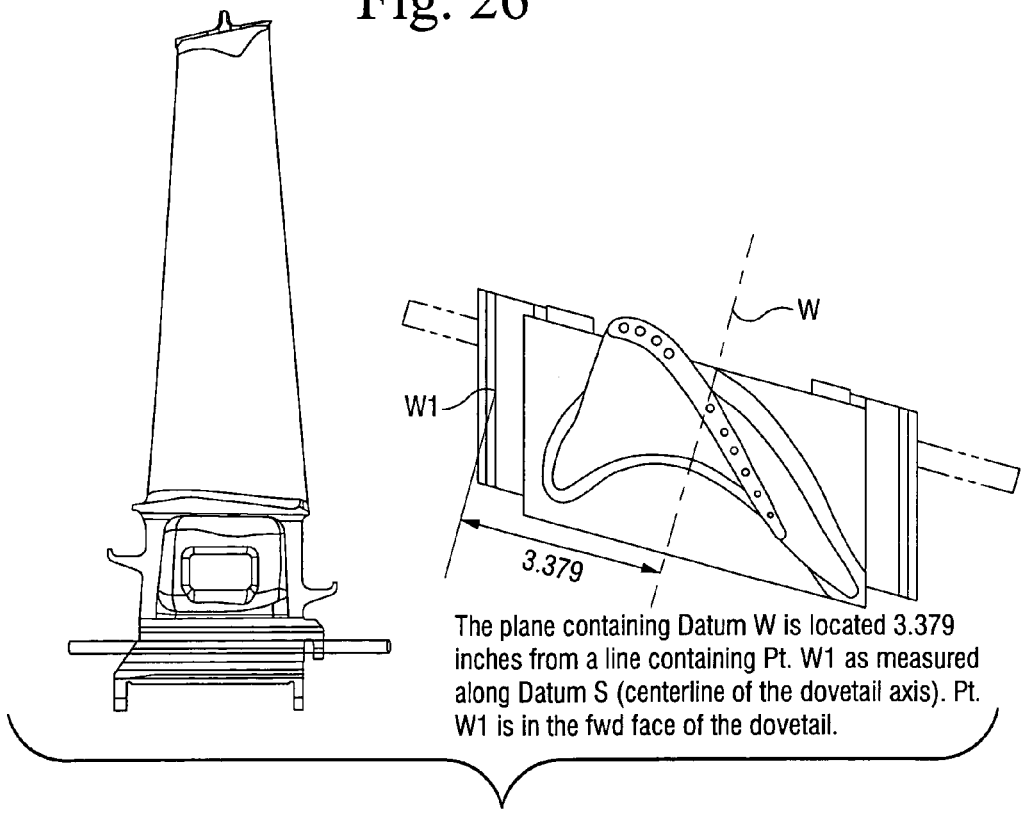

The datum line W also varies according to blade or disk geometry. The datum line W is positioned a fixed distance from a forward face of the blade or disk dovetail along a center line of the dovetail axis. FIGS. 21-27 illustrate the datum line W definition for each of the General Electric turbine classes referenced above and for each blade and disk stage. For example, FIG. 21 illustrates the datum line W definition for a stage 1 blade and disk in a first turbine class of a first type (6FA), where the datum line W is located 1.704 inches from a forward face of the blade and disk dovetail along the center line (datum S) of the dovetail axis. FIG. 22 illustrates the datum line W definition for a stage 1 blade and disk in a first turbine class of a second type (6FA+e), where the datum line W is located 1.698 inches from a forward face of the blade and disk dovetail along the center line (datum S) of the dovetail axis. FIG. 23 illustrates the datum line W definition for the second type first turbine class stage 2 blade and disk, where the datum line W is located 1.936 inches from the forward face of the blade and disk dovetail along a center line (datum S) of the dovetail axis. FIG. 24 shows the dimension as 2.470 inches for a stage 1 blade and disk in a second turbine class (7FA+e), and FIG. 25 shows the dimension as 2.817 inches for the stage 2 blade and disk of the second turbine class. FIG. 26 shows the dimension as 2.964 inches for the stage 1 blade and disk of a third turbine class (9FA+e), and FIG. 27 shows the dimension as 3.379 inches for the third turbine class stage 2 blade and disk. The datum line W provides an identifiable reference point for each stage blade and disk of each turbine class for locating the optimized dovetail backcut start point.

Details of the optimized start point and cut angle for each turbine class in each respective blade and disk stage will be described with reference to FIGS. 8-20. As noted, the optimized start point and cut angle for each dovetail backcut have been determined using finite element analyses in order to maximize a balance between stress reduction on the gas turbine disk, stress reduction on the gas turbine blades, a useful life of the gas turbine blades, and maintaining or improving the aeromechanical behavior of the gas turbine blade. Although specific dimensions will be described, the invention is not necessarily meant to be limited to such specific dimensions. The maximum dovetail backcut is measured by the nominal distance to the start point shown from the datum line W. Through the finite element analyses, it has been determined that a larger dovetail backcut would result in sacrifices to the acceptable life of the gas turbine blade. In describing the optimal dimensions, separate values may be determined for the number of tangs 20 of the blade dovetail 16 and/or the disk dovetail slots 14.

Figure 8:
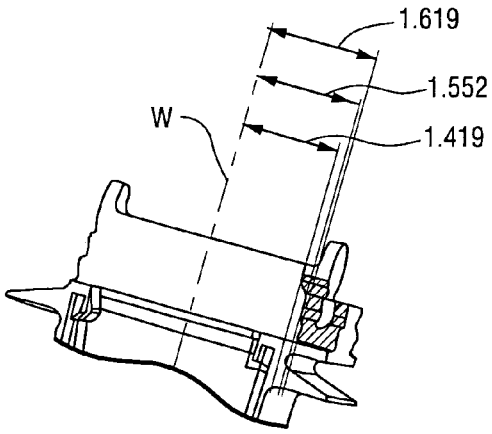
FIGS. 8 and 9 illustrate a material removal area for a stage 1 blade or disk in a first turbine class of a first type.
Figure 9:
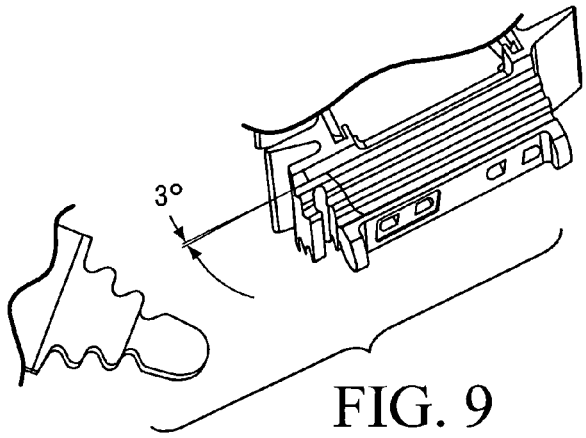

FIGS. 8 and 9 illustrate the values for the first type first turbine class stage 1 blade and disk which contains three sets of dovetail tangs here identified by the general width between the tang sets, where the start point of the dovetail backcut is at least 1.619 inches in an aft direction from the datum line W for the wide tang, at least 1.552 inches in an aft direction from the datum line W for the middle tang, and at least 1.419 inches in the aft direction from the datum line for the narrow tang. The cut angle is a maximum of 3°.

Figure 10:
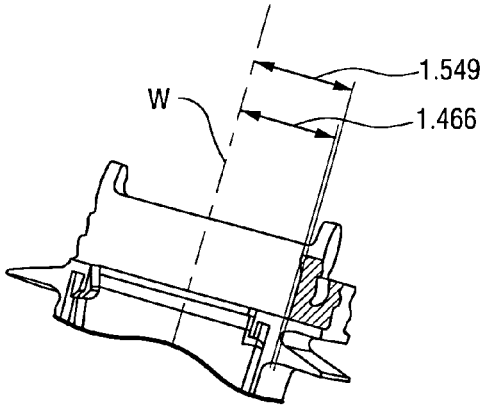
FIGS. 10 and 11 illustrate a material removal area for a stage 1 blade or disk in a first turbine class of a second type.
Figure 11:
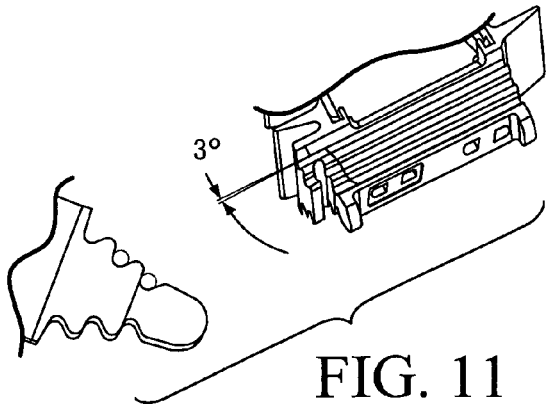
Figure 12:
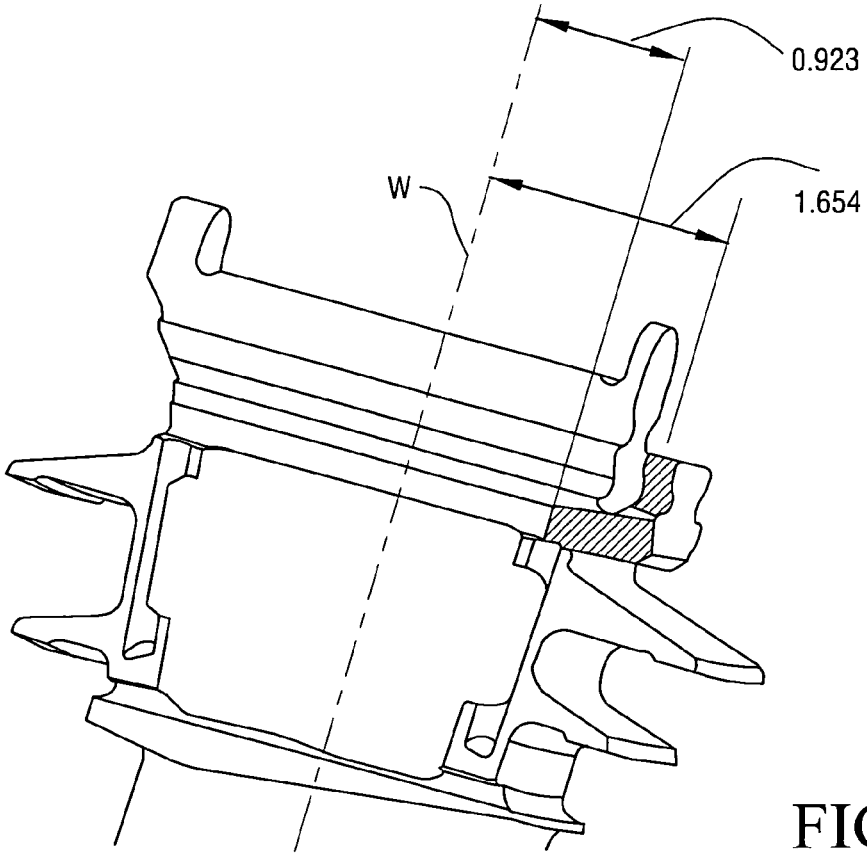
FIG. 12 shows a material removal area for a stage 2 blade or disk in the first turbine class.

FIGS. 10 and 11 illustrate the values for the second type first turbine class stage 1 blade and disk which contains three sets of dovetail tangs here identified by the general width between the tang sets, where the start point of the dovetail backcut is at least 1.549 inches in an aft direction from the datum line W for the wide tang and the middle tang and at least 1.466 inches in the aft direction from the datum line for the narrow tang. The cut angle is a maximum of 3°. The stage 2 blade and disk of the second type first turbine class which contains three sets of dovetail tangs here identified by the general width between the tang sets is illustrated in FIG. 12, showing a start point of the dovetail backcut at least 0.923 inches in the aft direction from the datum line W for the wide tang and at least 1.654 unches in the aft direction from the datum line W for the middle tang. The cut angle is a maximum of 5°.

Figure 13:
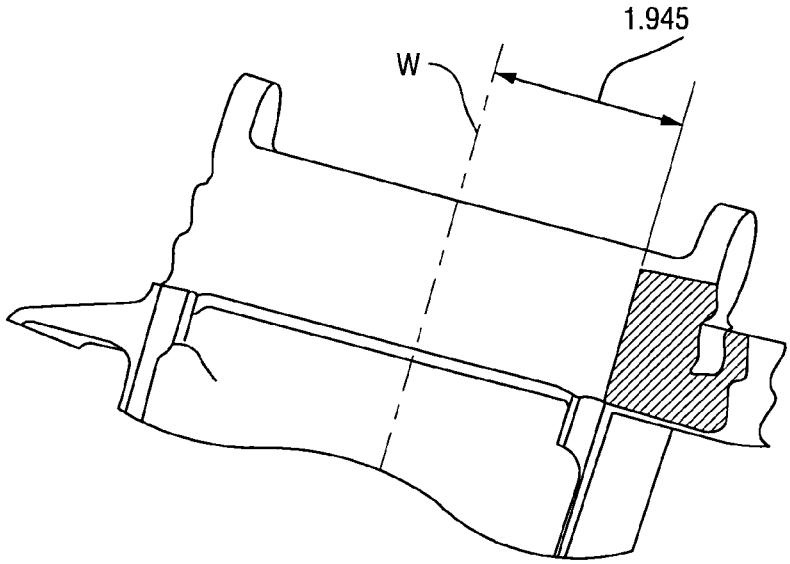
FIGS. 13 and 14 illustrate a material removal area for a stage 1 blade or disk in a second turbine class.
Figure 14:
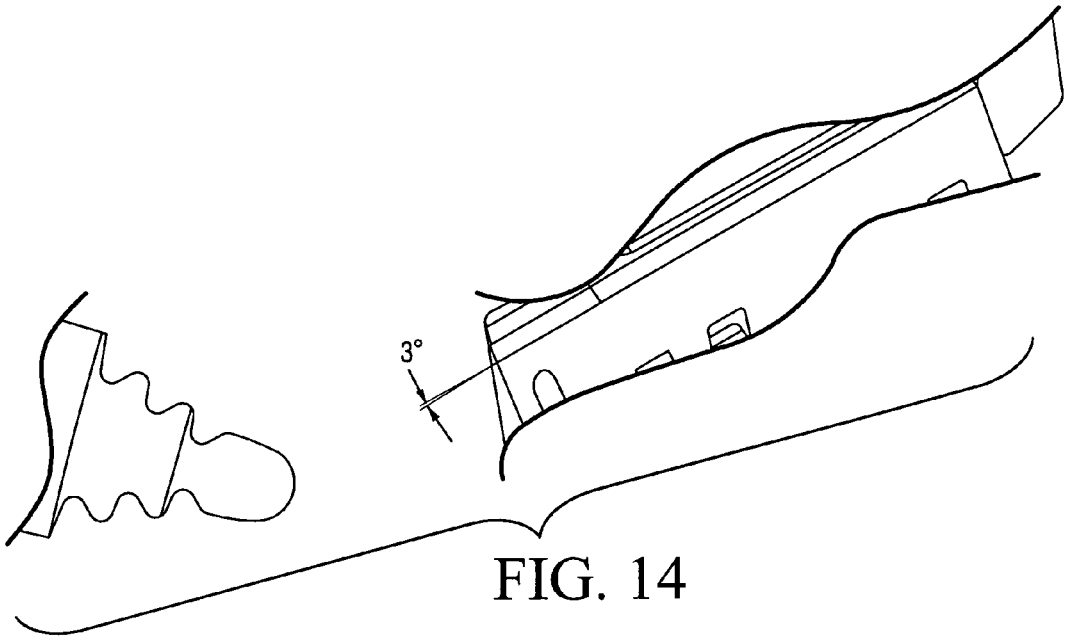
Figure 15:
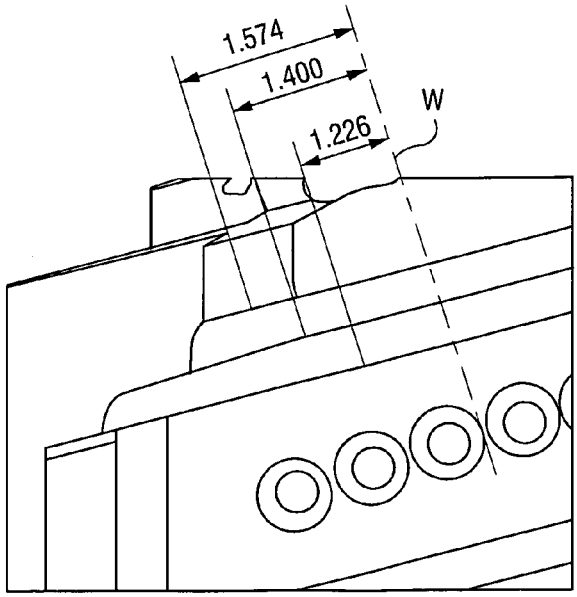
FIG. 15 shows a material removal area for a pressure side of a stage 2 blade or disk in the second turbine class.
Figure 16:
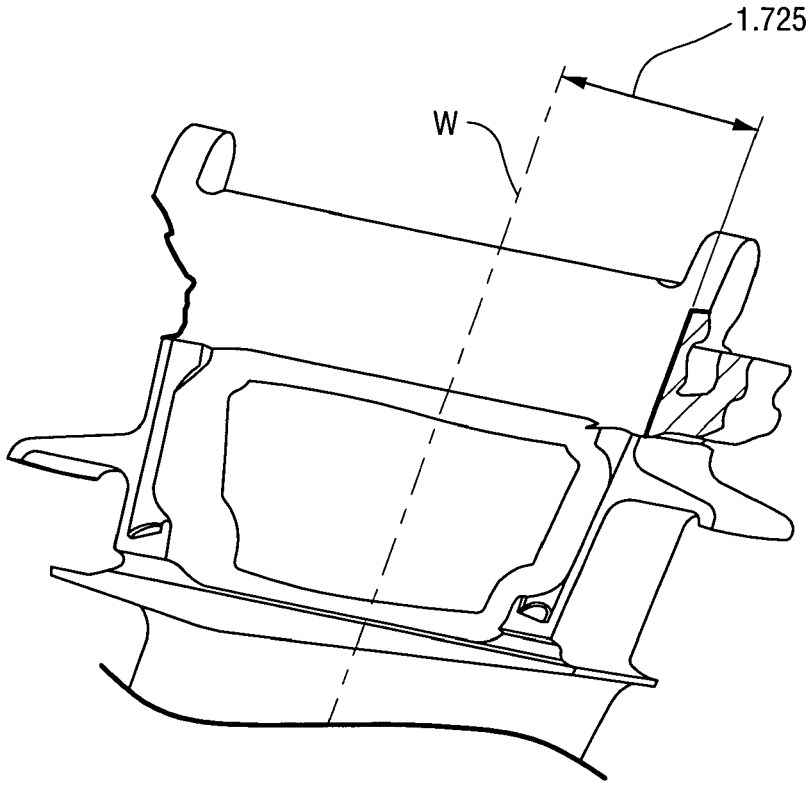
FIG. 16 shows a material removal area for a suction side of the stage 2 blade or disk in the second turbine class.

FIGS. 13 and 14 illustrate the values for the stage 1 blade and disk in the second turbine class which contains three sets of dovetail tangs. The start point of the dovetail backcut is at least 1.945 inches in the aft direction from the datum line, and the cut angle is a maximum of 3°. For the pressure side of the stage 2 blade and disk in the second turbine class which contains three sets of dovetail tangs here identified by the general width between the tang sets, FIG. 15 illustrates the start point of the dovetail backcut at least 1.574 inches in a forward direction from the datum line W for the wide tang, at least 1.400 inches in the forward direction from the datum line for the middle tang, and at least 1.226 inches in the forward direction from the datum line for the narrow tang. The cut angle is a maximum of 5°. For the suction side of the stage 2 blade and disk in the second turbine class which contains three sets of dovetail tangs, as shown in FIG. 16, the start point of the dovetail backcut is at least 1.725 inches in the aft direction from the datum line, and the cut angle is a maximum of 5°.

Figure 17:
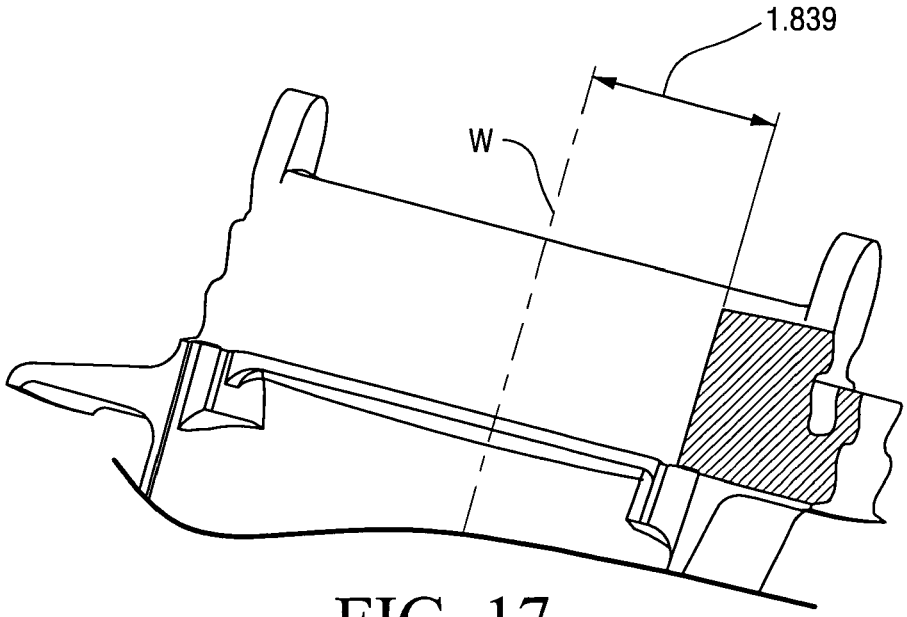
FIGS. 17 and 18 illustrate a material removal area for a stage 1 blade or disk in a third turbine class.
Figure 18:
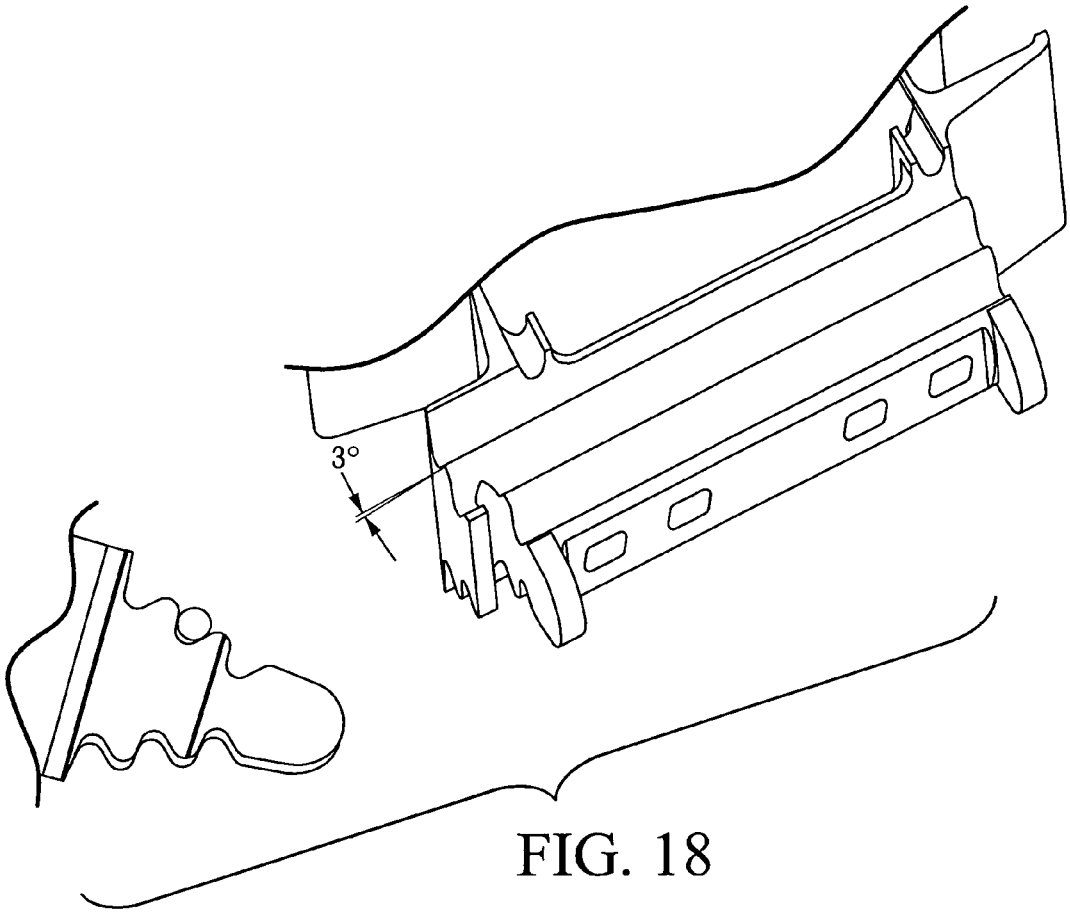
Figure 19:
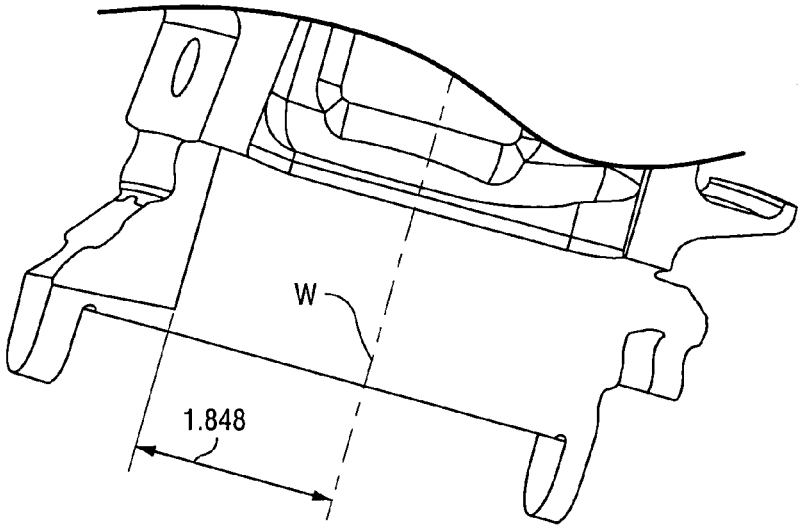
FIG. 19 shows a material removal area for a pressure side of a stage 2 blade or disk in the third turbine class.
Figure 20:
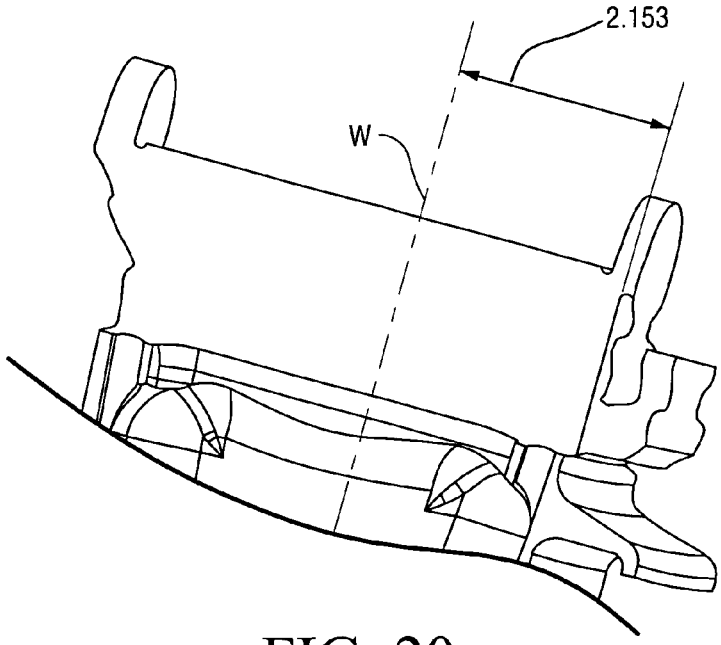
FIG. 20 shows a material removal area for a suction side of the stage 2 blade or disk in the third turbine class.

FIGS. 17 and 18 illustrate the stage 1 blade and disk for the third turbine class which contains three sets of dovetail tangs where the start point of the dovetail backcut is at least 1.839 inches in the aft direction from the datum line W. The cut angle is a maximum of 3°. The pressure side of the stage 2 blade in the third turbine class which contains three sets of dovetail tangs is illustrated in FIG. 19. The start point of the dovetail backcut is at least 1.848 inches in the forward direction from the datum line W, and the cut angle is a maximum of 5°. The suction side of the stage 2 blade and disk in the third turbine class which contains three sets of dovetail tangs is illustrated in FIG. 20. The start point of the dovetail backcut is at least 2.153 inches in the aft direction from the datum line W, and the cut angle is a maximum of 5°.

It is anticipated that the dovetail backcuts can be formed into a unit during a normal hot gas path inspection process. With this arrangement, the blade load path should be diverted around the high stress region in the disk and/or blade stress concentrating features. The relief cut parameters including an optimized start point relative to a datum line and an optimized cut angle define a dovetail backcut that maximizes a balance between stress reduction in the gas turbine disk, stress reduction in the gas turbine blades, a useful life of the gas turbine blades, and maintaining or improving the aeromechanical behavior of the gas turbine blade. The reduced stress concentrations serve to reduce distress in the gas turbine disk, thereby realizing a significant overall disk fatigue life benefit.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method for reducing stress on at least one of a turbine disk and a turbine blade, wherein a plurality of turbine blades are attachable to the disk, and wherein each of the turbine blades includes a blade dovetail engageable in a correspondingly-shaped dovetail slot in the disk, the method comprising:

(a) determining a start point for a dovetail backcut relative to a datum line, the start point defining a length of the dovetail backcut along a dovetail axis;

(b) determining a cut angle for the dovetail backcut; and (c) removing material from at least one of the blade dovetail or the disk dovetail slot according to the start point and the cut angle to form the dovetail backcut, wherein the start point and the cut angle are optimized according to blade and disk geometry to maximize a balance between stress reduction on the disk, stress reduction on the blade, a useful life of the turbine blades, and maintaining or improving the aeromechanical behavior of the turbine blade, wherein the datum line is positioned 2.470 inches from a forward face of the blade dovetail along a centerline of the dovetail axis, and wherein step (a) is practiced such that the start point of the dovetail backcut is at least 1.945 inches in an aft direction from the datum line.

2. A method according to claim 1, wherein step (b) is practiced such that the cut angle is a maximum of 3°.

3. A method according to claim 2, wherein optimizing of the start point and the cut angle is practiced by executing finite element analyses on the blade and disk geometry.

4. A method according to claim 1, wherein step (b) is practiced by determining multiple cut angles to define the dovetail backcut with a non-planar surface.

5. A method according to claim 1, wherein step (c) is practiced by removing material from the blade dovetail.

6. A method according to claim 1, wherein step (c) is practiced by removing material from the disk dovetail slot.

7. A method according to claim 1, wherein step (c) is practiced by removing material from the blade dovetail and from the disk dovetail slot.

8. A method according to claim 7, wherein step (c) is further practiced such that a resulting angle based on the material removed from the blade dovetail and the disk dovetail slot does not exceed the cut angle.

9. A turbine blade comprising an airfoil and a blade dovetail, the blade dovetail being shaped corresponding to a dovetail slot in a turbine disk, wherein the blade dovetail includes a dovetail backcut sized and positioned according to blade geometry to maximize a balance between stress reduction on the disk, stress reduction on the blade, a useful life of the turbine blade, and maintaining or improving the aeromechanical behavior of the turbine blade, wherein a start point of the dovetail backcut, which defines a length of the dovetail backcut along a dovetail axis, is determined relative to a datum line positioned 2.470 inches from a forward face of the blade dovetail along a centerline of the dovetail axis, and wherein the start point of the dovetail backcut is at least 1.945 inches in an aft direction from the datum line.

10. A turbine blade according to claim 9, wherein a cut angle of the dovetail backcut is a maximum of 3°.

11. A turbine blade according to claim 9, wherein the dovetail backcut has a non-planar surface.

12. A turbine rotor including a plurality of turbine blades coupled with a rotor disk, each blade comprising an airfoil and a blade dovetail, and the rotor disk comprising a plurality of dovetail slots shaped corresponding to the blade dovetail, wherein at least one of the blade dovetail and the dovetail slot includes a dovetail backcut sized and positioned according to blade and disk geometry to maximize a balance between stress reduction on the rotor disk, stress reduction on the blade, a useful life of the turbine blade, and maintaining or improving the aeromechanical behavior of the turbine blade, wherein a start point of the dovetail backcut, which defines a length of the dovetail backcut along a dovetail axis, is determined relative to a datum line positioned 2.470 inches from a forward face of the blade dovetail along a centerline of the dovetail axis, and wherein the start point of the dovetail backcut is at least 1.945 inches in an aft direction from the datum line.

* * * * *